US007896160B2

(12) United States Patent
Mutter

(10) Patent No.: US 7,896,160 B2
(45) Date of Patent: Mar. 1, 2011

(54) SYSTEM FOR SUPPLYING TUBULAR GEOTEXTILE MATERIAL FOR PERFORATED DRAIN PIPES

(75) Inventor: Paul Mutter, Brussels (CA)

(73) Assignee: Carriff Engineered Fabrics Corporation, Ontario (CA)

( * ) Notice: Subject to any disclaimer, the term of this patent is extended or adjusted under 35 U.S.C. 154(b) by 259 days.

(21) Appl. No.: 12/137,880

(22) Filed: Jun. 12, 2008

(65) Prior Publication Data

US 2009/0308769 A1 Dec. 17, 2009

(51) Int. Cl.
*B65D 85/00* (2006.01)

(52) U.S. Cl. ..... 206/395; 405/43; 405/49

(58) Field of Classification Search ..... 206/389, 206/395, 396, 407, 225, 226; 405/36, 43, 405/45, 49; 138/103, 121, 122; 493/309, 493/311

See application file for complete search history.

(56) References Cited

U.S. PATENT DOCUMENTS

| | | | | |
|---|---|---|---|---|
| 2,883,045 | A * | 4/1959 | Abramson | 206/396 |
| 3,481,456 | A * | 12/1969 | Watts | 206/395 |
| 3,830,373 | A | 8/1974 | Sixt et al. | |
| 3,939,875 | A | 2/1976 | Osborn et al. | |
| 3,946,762 | A | 3/1976 | Green | |
| 4,148,441 | A * | 4/1979 | Cohen | 206/389 |
| 5,395,191 | A * | 3/1995 | Keenan et al. | 206/593 |
| 6,740,818 | B2 * | 5/2004 | Clark | 174/135 |

* cited by examiner

*Primary Examiner*—J. Gregory Pickett
(74) *Attorney, Agent, or Firm*—Womble Carlyle Sandridge & Rice, PLLC

(57) ABSTRACT

Tubular geotextile fabric is mounted on a collapsible supply cartridge, which may be shipped to a perforated drain pipe manufacturer, distributor, or retailer in collapsed form to save shipping space. Upon receipt by the manufacturer or the others, the collapsible tube is reshaped to easily slide over the pipe. As the pipe pushes through the cartridge, the fabric becomes positioned thereon.

5 Claims, 5 Drawing Sheets

SYSTEM FOR SUPPLYING TUBULAR GEOTEXTILE MATERIAL FOR PERFORATED DRAIN PIPES

FIELD OF THE INVENTION

The present invention relates to the field of land drainage pipes, and more particularly to the tubular-knit filter fabric that surrounds perforated drainage pipes.

BACKGROUND OF THE INVENTION

Land drainage has long been accomplished through underground conduits or pipes formed of tile or tubing. In recent years, the tubing has taken the form of perforated flexible corrugated drainage tubing. In connection with such land drainage, it has long been recognized that certain types of soil will quickly clog drainage lines unless provision is made for protecting the drain tile or tubing against intrusion of soil particles. Various filter materials have been proposed and have been developed for preventing such early blockage of a drainage line, including knitted fabric protective sleeves or filters known as Circular-Knit geotextile or "sock" filtration fabric.

Circular knit geotextiles are commonly used to encase perforated pipe of various types to prevent the infiltration of soil particles into the perforated pipes when used in subsurface drainage systems. The most common type of perforated pipe onto which this product is installed is a corrugated high density polyethylene (HDPE), but the product is often applied onto perforated galvanized steel, perforated aluminum, polyvinylchloride (PVC) and ABS pipes. The pipes are produced in lengths of up to 5,000 lineal feet, depending upon the diameter of the pipe. The most common lengths of pipe are 10 feet, 25 feet, 50 feet, 100 feet and 250 feet and their metric equivalents.

The tubular-knit geotextile fabric is produced in a textile mill on circular knitting machines, collected on rolls, and is normally, but not always, supplied to the pipe manufacturers to be installed onto the pipes as the pipes are being manufactured. The length of fabric on each roll may, by coincidence, be similar to the pipe lengths, but is not normally sold or purchased in terms of lineal measure as the unit of sale is typically by weight, either pounds or kilograms. Alternatively the product is now sold in pre-measured roll or package lengths to be applied to the pipes at some later time.

The fabric is sold into two different markets, one being to manufacturers of the perforated pipe (OEM), the other to the consumer, end user or do-it-yourself via wholesale and retail outlets such as retail building supply and construction supply outlets who stock and sell the perforated pipe.

As far as the OEM market is concerned, large rolls of unspecified lengths of fabric are typically supplied to the perforated pipe manufacturer. The manufacturer then applies the fabric to the perforated tubing (typically as part of an inline process, as the tubing is being produced although it can be a secondary process). The tubing manufacturer then sells the fabric covered perforated pipe to installation contractors or to resellers of construction products, such as Home Depot, Lowe's, Ace Hardware, etc. The current practice by the pipe manufacturer is to initially transfer a length of fabric from the roll onto the outside of a cylindrical tube (commonly referred to as the application cylinder, tube or barrel). The cylinder is made of a variety of different materials such as steel, aluminum, or even PVC or ABS plastic of various length having an inside diameter of such size that a perforated pipe can pass through it. The application cylinders will vary in diameter depending upon the outside diameter of the perforated tubing to be covered and the type of material and thickness of the material from which the hollow application cylinder is made. The length of the hollow application cylinder usually is determined by (a) the physical space available within the manufacturing facility, (b) the type of materials from which the cylinder is made, and (c) the diameter of pipe and resulting fabric that is being used. The outside diameter and length of the cylinder, the maximum cross-wise stretch of the fabric and the method of application of the fabric to the cylinder dictates the maximum quantity of fabric that can be applied to the application cylinder.

The application cylinders vary in length from one manufacturer to another, but are typically 8 to 12 feet in length. By way of example, it is common to apply 2 to 3 of the rolls of fabric, each being approximately 900 feet in length, to a 12-foot long cylinder in a system applying fabric to a 4" diameter tubing.

The procedure can be time consuming and sometimes requires extra labor on the production floor. As extrusion line speeds have increased over the years to upwards of 120 feet per minute, the manufacturer is prevented from taking advantage of the increase in production rates available to them. They must slow their extrusion speeds to match the rate at which their employees can load the geotextile product to the application cylinders which requires the extrusion line speeds to be reduced to the range of 30-60 feet per minute.

More recently, automatic pipe coiling equipment has been introduced in North America that virtually eliminates the need for downstream labor in pipe production facilities. These systems allow 4-inch tubing to be produced and coiled at speeds of over 90 feet per minute. Unfortunately, however the automatic coiling systems, as they now exist, do not yet work well with filtered tubing due to difficulties in handling and transferring the filtered tubing. Currently when filtered pipe is being made, the automatic coilers must be taken offline and manual labor put back into the line.

The fabric, once loaded onto the exterior of the application cylinder, is typically tied into a knot or closed shut at the exiting end of the application cylinder or tube. As the pipe is extruded, corrugated and perforated, it enters into the application cylinder which is now covered with the knitted fabric and exits the cylinder at the opposite end. As the perforated tubing exits the cylinder, it pushes off and carries the geotextile fabric with it. The geotextile fabric is then properly seated on the outside of the perforated tube or pipe.

When the desired length of pipe has been produced, the now covered pipe is cut at the exiting end of the application cylinder, the fabric is retied and the process is repeated. When all the fabric has been consumed from the application cylinder, the pipe is severed at the entry end of the cylinder and is typically redirected into a second cylinder which has been covered with fabric as the fabric from the first cylinder is being applied. In some installations the system has no second cylinder and therefore the cylinder must be reloaded before production of geotextile covered tubing can begin again. The lead end of the pipe is joined to the end of the previous length, the fabric from the second cylinder is pulled over the fabric on the first length of pipe to form a continuous coverage of the perforated tubing and the process continues.

The other market, known as the do-it-yourself market or the retail market is where end users purchase rolls of non-covered, perforated tubing from any one of a number of supply outlets like Home Depot, Lowe's, Ace Hardware, etc. The non-covered perforated tubing is supplied to the retail outlets by the tubing manufacturers as described above. In addition to the perforated tubing, the consumer can and sometimes will purchase a pre-measured length of fabric which is normally packaged and supplied in roll form. The consumer or do-it-yourselfer must then apply the fabric themselves to the non-covered perforated tubing. Pulling the fabric over a length of tubing is not an easy task. Currently the fabric is sold to the retail outlets in packages of wound up fabric or in pre-measured lengths of fabric as arranged between the supplier and the retail outlet.

SUMMARY OF THE PRESENT INVENTION

The system of the present invention reduces the time required by the pipe manufacturers to apply the fabric to the application barrels, as well as facilitating the application of the fabric to the purchased tubes by the consumer in the do-it-yourself market. For this purpose, in accordance with the present invention, the fabric manufacturer or his contractor or distributor supplies the fabric to either the tube manufacturers or to the do-it-yourself market on supply cartridges. To do so, the fabric manufacturer or his contractor applies a pre-measured length of fabric to a cardboard or polymeric core in the textile mill or other appropriate location. The quantity of fabric applied to the core preferably, but not necessarily, corresponds to the lengths of perforated tubing to be produced by the pipe manufacturer, or to the length of tubing to be supplied to the consumer in the do-it-yourself market. The cores used by the fabric manufacturer have an inside perimeter dimension such that they will slide over the existing application cylinders at the pipe manufacturers or over the tubing being used by the consumer or do-it-yourselfer. In the case of the tubing manufacturer, the preloaded cartridges are then affixed or mechanically clamped to the application cylinders in the tube manufacturing plant, so that they will not easily slide off the end.

Preloaded cylindrical cartridges do not store conveniently in either the geotextile producer's facility nor in the pipe producer's facility due to the bulky nature of the product. In addition, the costs involved to transport the fabric-covered cylinders from the geotextile producer's facility to the pipe manufacturer's facility is not cost effective.

To overcome such problems, and what makes the present invention unique and viable is that the cartridge of the current invention is collapsible upon itself. Rather than being in the shape of a round cylinder as we know it, it is either in the shape of a collapsed circle or oval or perhaps even a collapsed square tube, or a collapsed polygonal tube having any number of sides and flexible angles running along its length which allows the shapes to be collapsed and re-shaped into a cylindrical shape or open polygon.

The pre-measured length of geotextile fabric is applied to the collapsible cartridge using a mechanical device and stacked upon one another efficiently in boxes or on skids, compressed, and may be banded with others to form a compressed package which can be stored and shipped cost-effectively. In use, by exerting force on the sides of the fabric-covered, collapsible cartridge, it may very easily be reshaped into the form of a cylinder or open polygon which can then be slid over and clamped or affixed to the existing application cylinders in the pipe manufacturing facility.

Transfer of the fabric onto the perforated tubing is to be performed as described previously. The difference is that the tubing will always be cut at the entrance end of the loading apparatus, either manually or mechanically and redirected into the next available cylinder. To hasten the loading operation, a rotating mandrel containing multiple cylinders may be utilized. The operator then needs only to keep the cylinders loaded with the collapsible, geotextile covered cartridges. Rotation of the mandrel may be accomplished either mechanically or manually.

In order for the collapsible cartridge to fit over the appropriate cylinder, the cross-section of the opened core must be so sized that it will fit over the application cylinder (in the case of OEM). Thus, the distance around the wall(s) which define the inside cross-sectional shape of the cartridge must be greater than the outside circumference of the corresponding hollow application cylinder at the manufacturer's facility. While the length of fabric supplied on a cartridge is not necessarily limited, shipping and logistical problems suggest that the amount of fabric on a cartridge should probably be limited, by way of example, to 250 feet of 4-inch fabric or 100 feet of six-inch fabric.

With respect to the retail or do-it-yourself market, the fabric is again pre-applied to a collapsed cartridge. The fabric is then knotted or temporarily closed on one end of the cartridge, which is then opened by the end user and the open end of the cartridge is placed over one end of the perforated tube. As the cartridge is slid along the length of the non-covered tubing, the tubing will exit the opposing end of the tubular cartridge, forcing the fabric off the cartridge and depositing the fabric on the exterior surface of the perforated tubing. Again the cross-section of the opened core must be sized and shaped that it will fit over the perforated tubing for which it was designed to cover. The collapsible cartridge would be of sufficient length and width to accommodate a specific quantity of fabric so as to most satisfactorily correspond to the length of perforated pipe for which it was designed. The length of fabric on a supply cartridge may be, but not necessarily, substantially the same as the lengths of perforated pipes that are commercially available. The fabric on a cartridge may be longer so as to cover a plurality of pipes, or it may be shorter so that it takes more than one cartridge to load a single pipe. Multiple lengths of tubular cartridges are anticipated to facilitate different quantities of fabric such as 75 feet, 100 feet, and 250 feet.

The collapsible cartridges may be manufactured either of paperboard, flexible plastic, or some other suitable material and can either be returnable to the fabric manufacturer or his contractor to be reloaded or alternatively be disposable. If formed of HDPE plastic material, it could be ground into particulate form by the user and blended with other HDPE resins to be extruded to manufacture the HDPE tubing.

One aspect of the invention is therefore to supply tubular geotextile fabric on a collapsible tubular core. The cross-section of the opened core must be so sized that it will fit over the application cylinder (in the case of OEM) or over the drainpipe itself (in the case of retail).

According to another aspect of the invention there is provided a method of supplying tubular geotextile material for emplacement on perforated drainpipe which includes the knitting of a tubular fabric, the placing of the knitted tubular fabric on a collapsible tubular core at the knitting site or that of his contractor, then shipping the collapsed loaded cartridges to the tubing manufacturer, wholesale or retail outlet or to the consumer or end user.

Other aspects of the invention may become apparent by a reading of the following detailed description of a preferred embodiment along with the accompanying drawings.

DETAILED DESCRIPTION OF A PREFERRED EMBODIMENT

Figure 1:
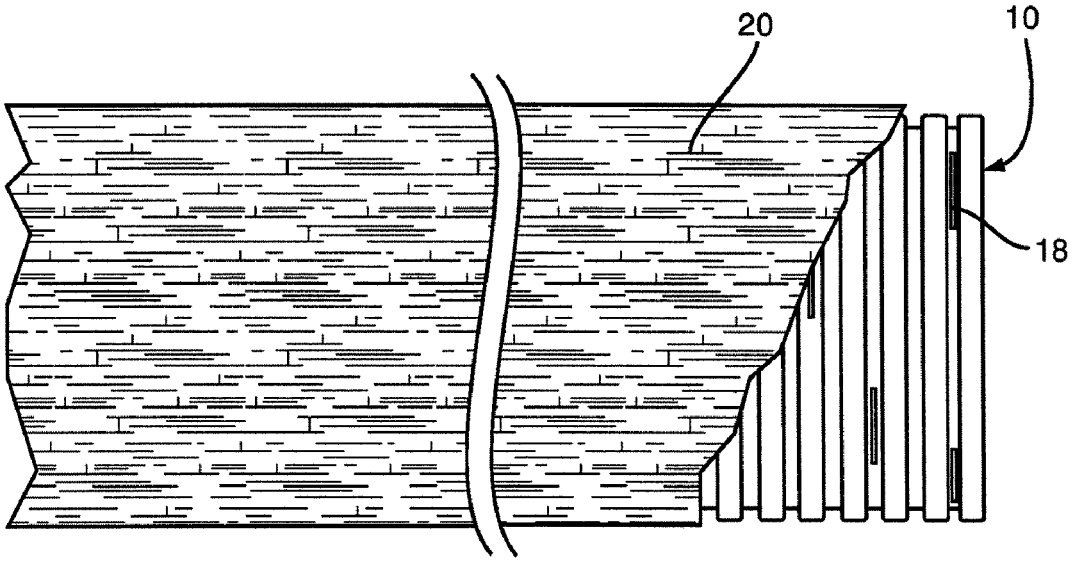
FIG. 1 (PRIOR ART)
FIG. 1 is an elevation view of a length of typical perforated drainage pipe having the geotextile material emplaced thereon and with a portion of the geotextile material being broken away to show the pipe therebeneath.

Referring in more particularity to FIG. 1, there is illustrated a typical flexible corrugated drainage tube 10 having tubular geotextile fabric sleeve 20 emplaced thereon. The tube is perforated at 18 and generally corrugated with alternating peaks and valleys, however some drainpipe is not corrugated, but is merely smooth-walled and cylindrical. The supply cartridge of the present invention may be utilized with either type of perforated tubing. The tube 10 is typically fabricated of durable, high density polyethylene although other materials may be suitable.

The geotextile fabric sleeve 20 is generally a circular knit sleeve of non-biodegradable polyester, polypropylene, polyethylene, or other polyamides. While a knit construction is preferred and typical, other fabric constructions are possible. The sleeves may be formed with diameters of 1 inch to 30 inches, however 3 inches, 4 inches, and 6 inches are typical.

Figure 2:
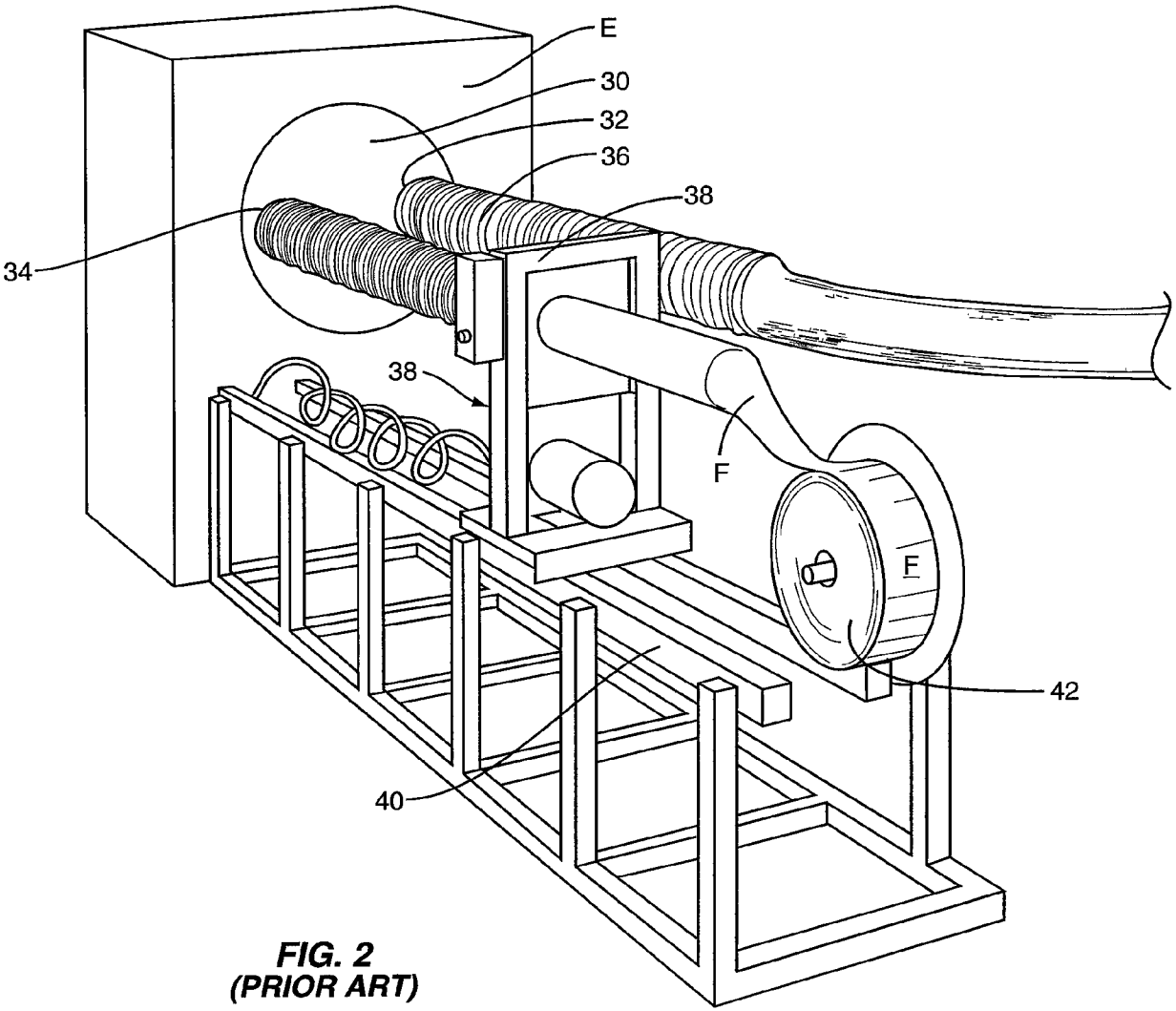
FIG. 2 (PRIOR ART)
FIG. 2 is a perspective view of a typical tubing extruder installation, illustrating the typical manner in which the knit fabric has previously been loaded onto application cylinders, then placed in position for loading onto the perforated pipe as it is extruded or loaded onto tubing as a secondary process.

Turning now to FIG. 2, there is illustrated a rather conventional perforated pipe tubing manufacturing system currently in operation. The extruder E (shown schematically) conventionally includes an extrusion barrel 36 through which heated polymeric material is forced and out through a die into the shape of tubing. As the tubing exits the extruder E, the corrugations and perforations are applied by appropriate molding equipment which is well-known but not shown. The perforated corrugated pipe then exits through a circular disk-shaped device 30. The disk-shaped device 30 is selectively rotatable, so that live extruded plastic tubing exits through one opening 32 in the disk 30, while at a second position or opening 34 on the disk 30, another application barrel 36 extends and whereon a loading operation is occurring. At each location 32, 34 on the rotating disk 30, a hollow application cylinder or barrel 36 extends horizontally. As previously mentioned, the application cylinders may be formed of steel, aluminum, PVC, or other suitable material and of various lengths. The cylinders 36 must have an inside diameter slightly greater than the outer diameter of the plastic tubing being extruded, so that the tubing can move freely through the application cylinder 36.

As extruded tubing is being produced through one of the cylinders 36 on one side of the disk 30, the other cylinder 36 on the other side is being loaded with geotextile fabric F. For this purpose, the application cylinder being loaded operates in conjunction with a loading frame 38. Loading frame 38 is mounted on a rail 40 and moves back and forth to feed the geotextile fabric from the spindle 42 onto the application cylinder.

In practice, the application cylinder 36 on the left-hand side of rotating disk 30 in FIG. 2 is to be loaded. Fabric F from spindle 42 is initially placed onto the outside of the free end of application cylinder 36 through the housing 38. The housing 38 then continuously slides back and forth along track 40 to feed more and more fabric onto the application cylinder until it is full.

When the right-hand loaded cylinder 36 becomes empty, the extruded material is cut and removed from the application cylinder. The disk 30 is rotated 180° to a position where the newly loaded cylinder 36 is adjacent the outlet end of the tubing perforator. More material is extruded and connected to the tail end of the previously extruded tubing. The new free end of the textile fabric F at the opposite end of the application cylinder 36 is manually fed along the extruded tubing and connected to the existing textile fabric. Then production resumes as described above. The covered tubing may be cut to lengths or loaded into a coil on a reel (not shown).

In some tubing manufacturers, the extruder has only a single application cylinder. In such cases, when the cylinder becomes empty, the extruded tubing is cut and production of geotextile covered tubing stops until a new supply of fabric can be manually fed onto the application cylinder. Then the tubing and fabric are connected as described above.

Figure 3:
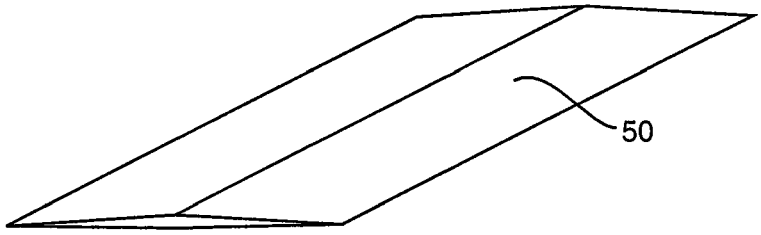
FIG. 3 is a perspective view of one form of an empty rectangular core in its collapsed form according to the present invention.
Figure 4:
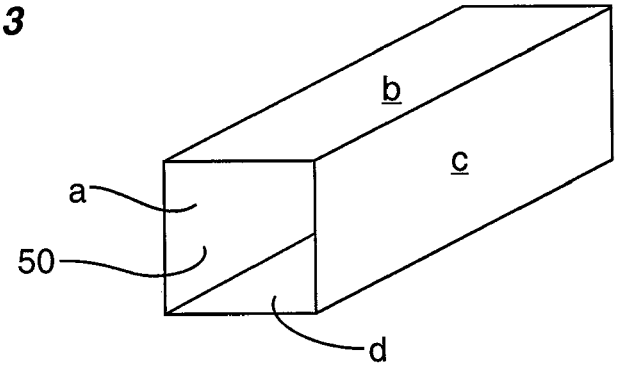
FIG. 4 is a perspective view similar to FIG. 3, except showing the core open.

Turning now to FIGS. 3 and 4, there is illustrated one embodiment of a collapsible core, preferably formed from cardboard, fiberboard, or paperboard. This collapsible core 50 is formed from a flat sheet of paperboard or the like with the free ends connected to form the configuration illustrated in FIG. 3. As illustrated in FIG. 4, the core 50 can be opened, and eventually will form a rectangular or square tubular configuration. The cores 50 should be of a length and width determined by the use for which they are intended. If for a tubing manufacturer having a system as illustrated in FIG. 2, the cores 50 should ideally be of a length about the same or slightly less than application cylinders 36. If for a retailer or do-it-yourselfer they should be of such length as to facilitate the desired quantity of fabric for the corresponding length of perforated tubing to be covered. Obviously, the cores 50 can be of any other length requested or specified by a customer.

Figure 5:
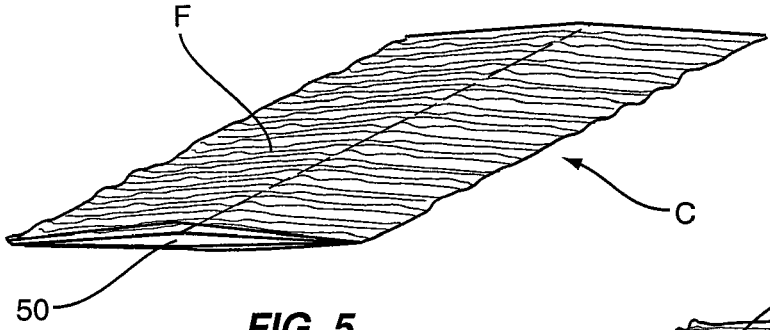
FIG. 5 is a perspective view illustrating a loaded cartridge which includes the core of FIGS. 3 and 4 and a length of fabric thereon in collapsed form.
Figure 6:
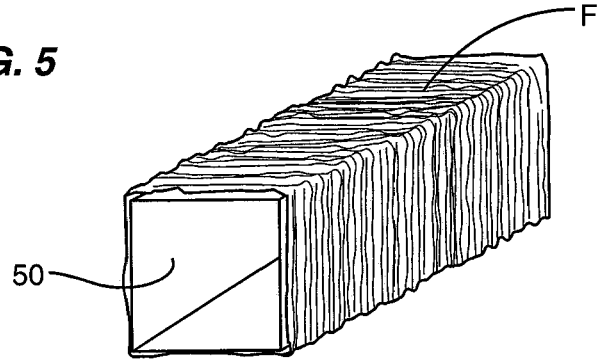
FIG. 6 is a perspective view similar to FIG. 5, except showing the cartridge open.

Turning to FIGS. 5 and 6, there is shown the core 50 loaded with a length of tubular geotextile fabric F. As explained earlier, typically lengths of fabric up to 250 feet in length of 4-inch fabric or 100 feet of 6-inch fabric will be loaded onto the cores 50 for supplying to the original tubing manufacturers. However, the length of fabric F on a core 50 may vary as desired or specified. In fact, should the manufacturers or other customers desire more fabric, more fabric could be loaded onto each cartridge, which can be supplied in lengths up to 15 feet long. While longer lengths are possible, shipping and storage would probably make such greater lengths impractical.

Figure 7:
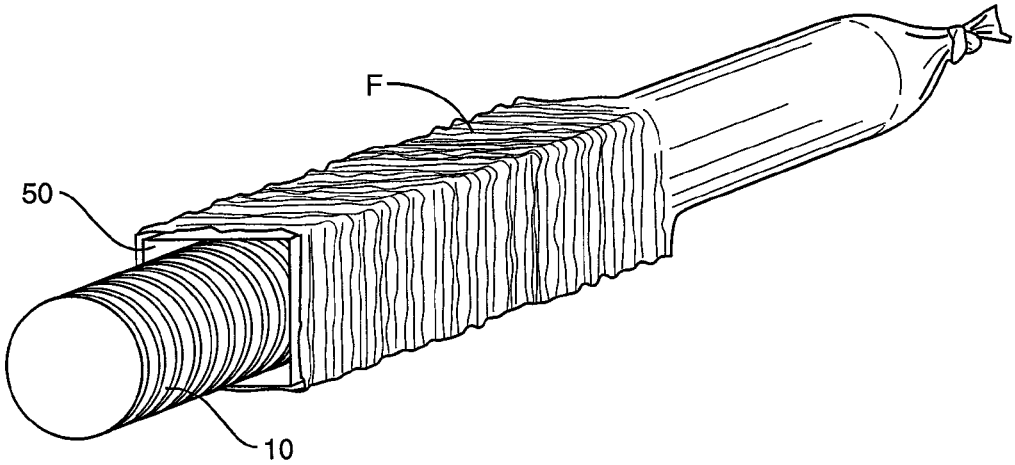
FIG. 7 is a perspective view illustrating the cartridge of FIGS. 3-6 emplaced on a length of perforated pipe in accordance with the present invention as the pipe is being loaded.
Figure 10:
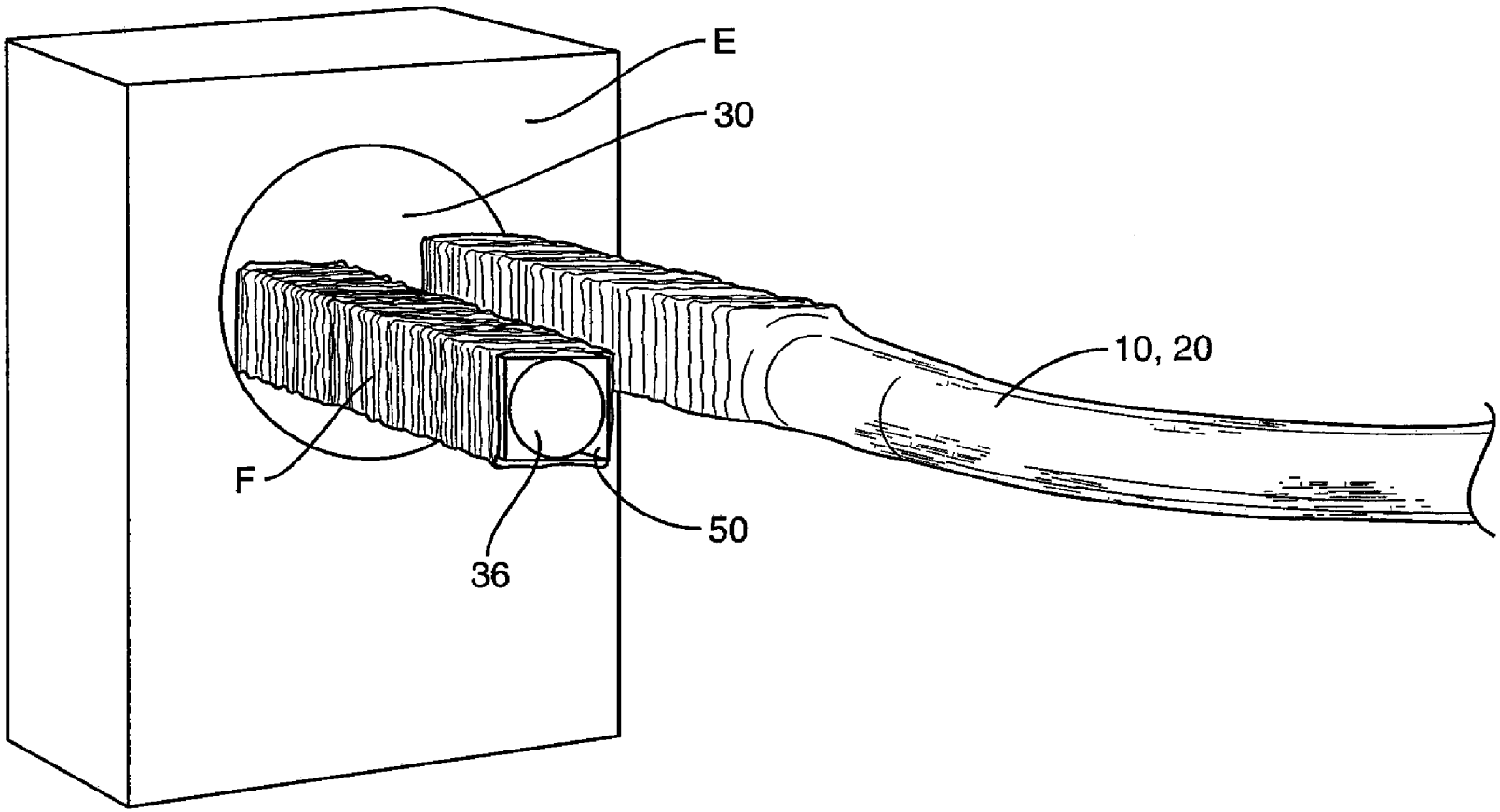
FIG. 10 is a perspective view of a tubing extruder now utilizing the cartridges of the present invention as they would be utilized.

For the retail or do-it-yourself market, the cartridges C could again cover lengths of perforated tubing up to 250 feet or more. Further, the fabrics could have relaxed diameters of 1 inch through 30 inches. As illustrated in FIGS. 7 and 10, the opened and reshaped collapsible cartridge 50 will easily fit over the end of an application tube 36 in the case of tube manufacturers, or will easily slide over perforated tubing 10 itself in the case of the retail market.

Figure 8:
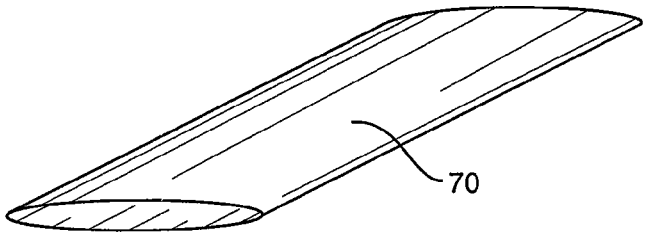
FIG. 8 is a perspective view of an alternate form of the core formed of a cylindrical flexible plastic material.
Figure 9:
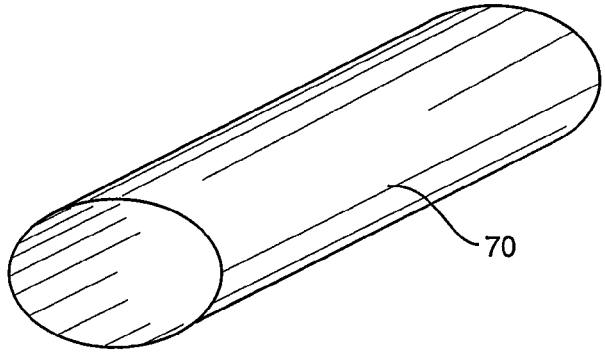
FIG. 9 is a perspective view similar to FIG. 8, except showing the cartridge in its open configuration.

In FIGS. 8 and 9, there is illustrated an alternative embodiment, which includes, a flexible plastic tube 70 formed of recyclable plastic such as high density polyethylene, or other polymeric material which can either be returned, recycled, or otherwise disposed of. The polymeric material needs to be flexible, similar to a toothpaste tube, so that it can be initially flattened, loaded with fabric, then shaped into cylindrical form for positioning on the application cylinder or barrel, or onto the plastic tubing itself.

In addition to the square, rectangular, or cylindrical configurations, the collapsible cartridge could be initially formed in any multi-sided or polygonals shape, so long as it may be initially loaded and shipped relatively flat, then opened into a tubular configuration, whether it be round, square, hexagonal, octagonal, or of other polygonal cross-sectional shape.

Whatever the cross-sectional shape, it must be of size that the opened core will fit over the application cylinder for which it is intended or the perforated pipe for which it is intended. This means the distance around the inner surface of the wall (s) a,b,c,d (FIG. 4) must be greater than the outside circumference of the application cylinder or the perforated pipe for which it is intended. For example, if the core has a polygonal shape the combined widths of the inner walls must be greater than the circumference of the application cylinder or the perforated pipe. If the core is round when opened, the diameter of the inner surface of the core must be greater than the outer diameter of the cylinder or pipe.

Once the cartridge is received by the tube manufacturer or the retail outlet or the consumer, the collapsible tube can be very easily reshaped into the form of an application cylinder or geotextile covered hollow tubular shape by exerting force on the sides of the fabric-covered cartridge. The cartridge can then be easily slide over and clamped or affixed to the existing application cylinders or barrels in the pipe manufacturing facility. Transfer of the fabric onto the perforated tubing would be performed as described previously, the difference being that the tubing would always be cut at the entrance end of the loading apparatus, either manually or mechanical and redirected into the next available application cylinder or barrel.

To hasten the loading operation, a rotating mandrel containing more than two application cylinders could be utilized. The operator would then only need to keep the application cylinders loaded with the collapsible, geotextile covered cartridges. Rotating of the disk carrying the application cylinders can be accomplished either mechanically or manually.

In the drawings and specification, there has been set forth a preferred embodiment of the invention, and although specific terms are employed, they are used in a generic and descriptive sense only and not for purposes of limitation.

I claim:

1. A supply cartridge containing tubular geotextile fabric comprising:

a) a collapsible tubular core;

b) a length of tubular geotextile fabric accumulated on the collapsible core in the collapsed state, the length of fabric being substantially greater than the length of the core;

c) the core having the ability to be expanded while still holding the fabric; and d) whereby the core may be collapsed for shipping and storage and opened or reshaped back to a tubular shape of sufficient size and shape as to permit movement of a length of perforated drain pipe therethrough to facilitate emplacement of the tubular fabric on the perforated drain pipe for which it is intended.

2. The supply cartridge of claim 1 wherein the core is made from a material selected from the group consisting of paperboard, cardboard, and fiberboard formed into a polygonal cross sectional configuration, the core being collapsible at the intersection of the sides to provide relatively flat configuration for storage and shipping and moveable to a tubular cross-sectional configuration.

3. The supply cartridge of claim 1 wherein the tubular core is made from a flexible polymeric material collapsible into a relatively flat configuration for shipping and storage and expandable to a tubular cross-sectional configuration.

4. The supply cartridge of claim 3 wherein the cross-sectional configuration is substantially circular.

5. The supply cartridge of claim 3 wherein the tubular core is made from high density polyethylene.

* * * * *